US006631867B2

(12) United States Patent
Minakawa

(10) Patent No.: US 6,631,867 B2
(45) Date of Patent: Oct. 14, 2003

(54) IMAGE FORMING APPARATUS

(75) Inventor: Yoshihisa Minakawa, Machida (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/931,947

(22) Filed: Aug. 20, 2001

(65) Prior Publication Data

US 2002/0060399 A1 May 23, 2002

(30) Foreign Application Priority Data

Aug. 30, 2000 (JP) ..... 2000-260431

(51) Int. Cl.[7] ..... B65H 16/04; B65H 23/02; B65H 75/18

(52) U.S. Cl. ..... 242/559.1; 242/566; 242/591; 242/597.5

(58) Field of Search ..... 242/559.1, 566, 242/591, 592, 597, 597.1, 597.2, 597.3, 597.4, 597.5, 597.6, 597.8; 400/613, 618

(56) References Cited

U.S. PATENT DOCUMENTS 760,133 A * 5/1904 Levy ..... 242/591
1,170,217 A * 2/1916 Buffum et al. ..... 242/597.2
1,292,640 A * 1/1919 Phelps ..... 242/592
1,347,956 A * 7/1920 Kochobo ..... 242/591
2,014,884 A * 9/1935 Euth ..... 400/613
2,240,629 A * 5/1941 Smith ..... 242/592
3,127,017 A * 3/1964 Dower ..... 242/597.5
4,360,172 A * 11/1982 Cope ..... 242/592
5,033,881 A * 7/1991 Koike ..... 400/613
5,299,874 A * 4/1994 DeVoe ..... 400/613
5,765,775 A * 6/1998 Keserica ..... 242/597.5

FOREIGN PATENT DOCUMENTS

JP 2000-155449 6/2000

* cited by examiner

*Primary Examiner*—John M. Jillions
(74) *Attorney, Agent, or Firm*—Oblon, Spivak, McClelland, Maier & Neustadt, P.C.

(57) ABSTRACT

An image forming apparatus of the type dealing with relatively wide documents of the present invention includes a generally L-shaped bar. The bar extends from one side of an apparatus body to a position above a document table and is angularly movable in the direction of width of the apparatus body. The bar includes a horizontal portion that includes a semicircular trough playing the role of a document guide. A document or documents are simply rolled up together and then put on the horizontal portion. The documents are pulled out of the horizontal portion one by one and inserted into the apparatus body.

11 Claims, 2 Drawing Sheets

IMAGE FORMING APPARATUS

BACKGROUND OF THE INVENTION

1. Field of the Invention

The present invention relates to a scanner, copier or similar image forming apparatus and more particularly to an image forming apparatus of the type dealing with relatively wide documents.

2. Description of the Background Art

As for an image forming apparatus of the type described, it is preferable for the operator of the apparatus to stack relatively wide documents to be read in the vicinity of the position where the operator stands. However, conventional image forming apparatuses of the type described do not include a portion that allows the operator to stack such documents before actual operation.

In light of the above, a table is often placed in the vicinity of, e.g., a scanner, so that the operator can stack wide documents on the table before operation. The operator puts one document on the document table of the scanner and causes the scanner to read it. The operator 4 then turns about to pick up another document from the table and again turns about to put it on the document table of the copier. This kind of work is troublesome to perform and makes the operator tired.

Technologies relating to the present invention are disclosed in, e.g., Japanese Patent Laid-Open publication No. 2000-155449.

SUMMARY OF THE INVENTION

It is an object of the present invention to provide an image forming apparatus allowing the operator of the apparatus to sequentially handle a stack of wide documents with a minimum of change in position and thereby promoting efficient operation.

In accordance with the present invention, in an image forming apparatus including a document holding device for temporarily holding a relatively wide document before the apparatus reads the document, the document holding device includes a supporting member movably mounted on a preselected portion of the body of the apparatus, and a holding member for holding the document.

Also, in accordance with the present invention, in an image forming apparatus dealing with a relatively wide document, a bar capable of holding the documents rolled up is supported by one side of the body of the apparatus in such a manner as to be angularly movable in the direction of depth of the body.

Further, in accordance with the present invention, in an image forming apparatus dealing with a relatively wide document, a bar capable of holding the document rolled up is mounted on the body of the image forming apparatus in such a manner as to be movable up and down above the document inserting portion of the apparatus adjoining the front end of the apparatus.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
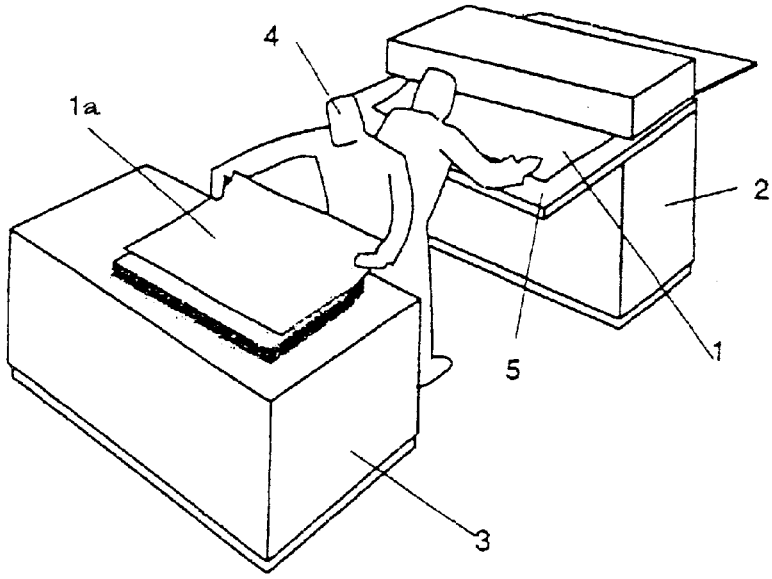
FIG. 1 PRIOR ART
FIG. 1 is an isometric view showing a conventional image forming apparatus of the type dealing with relatively wide documents.

To better understand the present invention, brief reference will be made to a conventional image forming apparatus of the type dealing with relatively wide documents, shown in FIG. 1. As shown, the image forming apparatus is implemented as a scanner including a body 2. It is a common practice to place a table 3 in the vicinity of the scanner body 2, so that the operator 4 of the scanner can stack wide documents before actual operation. The operator 4 puts one document 1 on a document table 5 included in the scanner and causes the scanner to read it. The operator 4 then turns about to pick up another document 1*a* stacked on the table 3 and again turns about to put the document 1*a* on the document table 5. This kind of work is troublesome to perform and makes the operator 4 tired.

Figure 2:
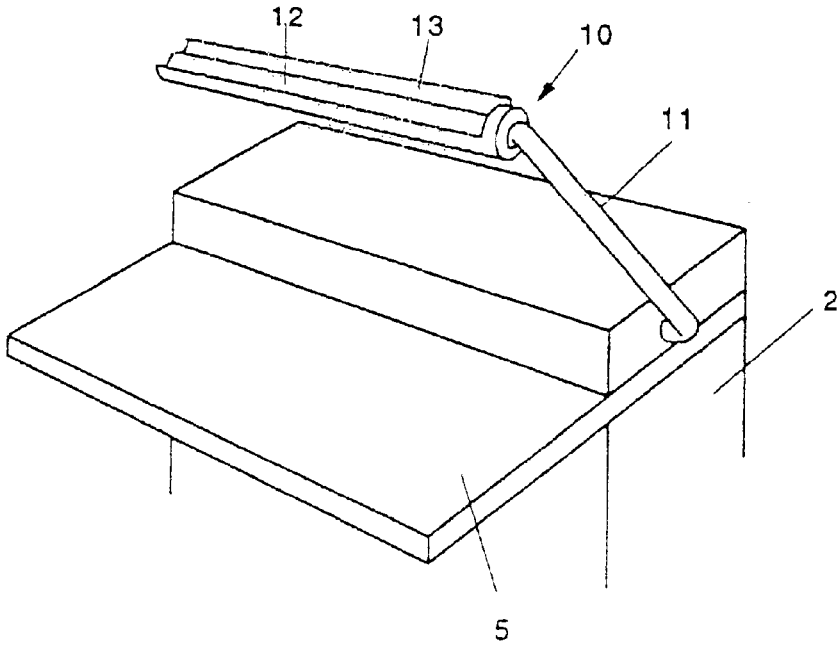
FIG. 2 is a fragmentary isometric view of an image forming apparatus embodying the present invention.

Referring to FIG. 2, an image forming apparatus embodying the present invention is shown and also implemented as a large-size scanner capable of dealing with relatively wide documents. Structural elements identical with those of the conventional scanner are designated by identical reference numerals and will not be described specifically in order to avoid redundancy. As shown, the scanner includes a generally L-shaped bar or document holding device 10 protruding from a suitable portion of a scanner body 2, e.g., one side of the scanner body 2 to a position above a document table 5.

The L-shaped bar 10 is generally made up of a vertical portion 11 and a horizontal portion 12. The vertical portion or supporting member 11 is supported by one side of the scanner body 2 in such a manner as to be angularly movable in the direction of depth of the scanner body 2. The horizontal portion or holding portion 12 extends horizontally from the upper end of the vertical portion 11. In the illustrative embodiment, the bar 10 is implemented by a rod having a circular cross-section whose diameter is about 15 mm. The horizontal portion 12 is configured to hold a document 1 having a width of A0 (841 mm×1,189 mm) above the document table 5. The horizontal portion 12 includes a semicircular trough or document guide 13 having an open top.

The scanner additionally includes locking means, not shown, for locking the bar 10 at a desired angular position. The locking means is customary with, e.g., a cover plate included in a copier.

Figure 3:
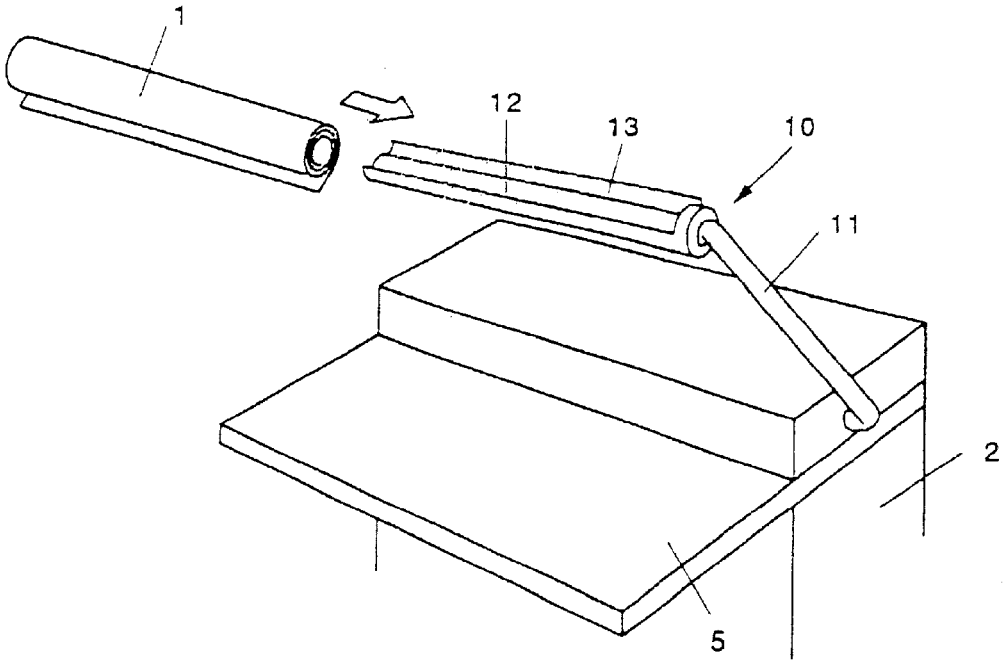
FIG. 3 is a view similar to FIG. 2, showing how a document is set on the apparatus of the illustrative embodiment.

As shown in FIG. 3, the operator of the scanner should only roll up the document and then put it on the horizontal portion 12 of the bar 11 from the free end of the portion 12. The operator may roll up a stack of documents 1 and set it on the horizontal portion 12, if desired. The horizontal portion 12 can hold a number of documents 1 if the diameter of the trough 13 is adequately selected.

Figure 4:
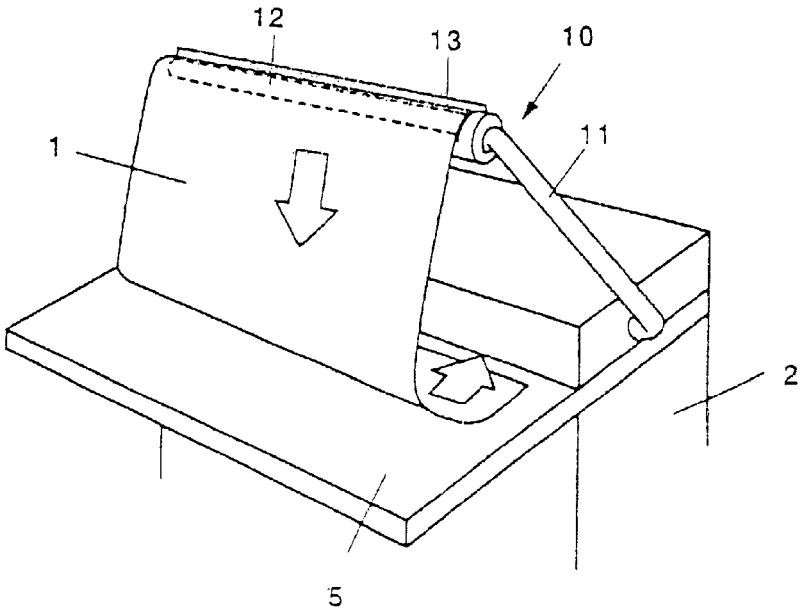
FIG. 4 is a view also similar to FIG. 2, showing how the document is fed into the apparatus of the illustrative embodiment.

As shown in FIG. 4, the operator pulls out one document from the horizontal portion 12 at a time and inserts it into the scanner body 2. At this instant, the operator may angularly move the vertical portion 11 toward or away from the operator in order to lower or raise the horizontal portion 12 to a position matching with, e.g., the operator's height. The operator can therefore easily deal with the documents 1.

The illustrative embodiment can handle not only wide documents but also narrow documents if the height of the horizontal portion 12 is varied by hand.

While the bar 11 has been shown and described as being angularly movable toward and away from the operator, it may be configured to be movable up and down above the document table 5.

In summary, it will be seen that the present Invention provides an image forming apparatus that frees the operator of the apparatus from repeated tiring work and promotes efficient operation.

Various modifications will become possible for those skilled in the art after receiving the teachings of the present disclosure without departing from the scope thereof.

What is claimed is:

1. In an image forming apparatus comprising a document holding device for temporarily holding a relatively wide document before said image forming apparatus reads said document, said document holding device comprises a supporting member movably mounted on a preselected portion of a body of said image forming apparatus, and a holding member for holding said document, wherein said holding member includes a guide for guiding documents, and wherein said guide comprises a semicircular trough having an open top.

2. The apparatus as claimed in claim 1, wherein said support member and said holding member are constructed integrally with each other as a single bar.

3. The apparatus as claimed in claim 2, wherein said supporting member is mounted on said body such that said holding member is movable toward and away from a document reading position on said body.

4. The apparatus as claimed in claim 3, wherein said supporting member is angularly movable in a direction of depth of said body.

5. The apparatus as claimed in claim 3, wherein said supporting member is movable up and down above the document reading position of said body.

6. The apparatus as claimed in claim 2, wherein said bar is generally L-shaped.

7. The apparatus as claimed in claim 6, wherein said holding member comprises a rod having a circular cross-section and allows a plurality of documents rolled up together to be put thereon.

8. In an image forming apparatus dealing with a relatively wide document, a bar capable of holding said document rolled up is supported by one side of a body of said image forming apparatus in such a manner as to be angularly movable in a direction of depth of said body, said bar having a holding member for holding said document, herein said holding member includes a guide for guiding documents, and wherein said guide comprises a semicircular trough having an open top.

9. The apparatus as claimed in claim 8, wherein said bar allows a plurality of documents rolled up to be put thereon.

10. In an image forming apparatus dealing with a relatively wide document, a bar capable of holding said document rolled up is mounted on a body of said image forming apparatus in such a manner as to be movable up and down above a document inserting portion of said forming apparatus adjoining a front end of said image forming apparatus, said bar having a holding member for holding said document, wherein said holding member includes a guide for guiding documents, and wherein said guide comprises a semicircular trough having an open top.

11. The apparatus as claimed in claim 10, wherein said bar allows a plurality of documents rolled up together to be put thereon.

* * * * *